United States Patent [19]

Primm, deceased

[11] 4,227,884

[45] Oct. 14, 1980

[54] METHOD OF HANDLING YARN

[76] Inventor: Richard W. Primm, deceased, late of Thomasville, N.C., by Gertrude B. Primm, executrix

[21] Appl. No.: 34,201

[22] Filed: Apr. 27, 1979

[51] Int. Cl.[3] ..... D06B 5/18; D06B 23/00

[52] U.S. Cl. ..... 8/155.1; 28/286; 242/18 DD

[58] Field of Search ..... 8/154, 155, 155.1, 155.2; 68/189, 198; 28/285, 286; 242/18 DD

[56] References Cited

U.S. PATENT DOCUMENTS

| | | | |
|---|---|---|---|
| 1,534,412 | 4/1925 | Remington | 68/198 X |
| 1,967,252 | 7/1934 | Moritz | 8/155 X |
| 3,419,925 | 1/1969 | Scroggie et al. | 8/155.1 |

*Primary Examiner*—Philip R. Coe

[57] ABSTRACT

The present invention consist of a method and apparatus for treating texturized yarn to improve its quality whereby a yarn is produced with greater bulk and more uniformity and dyeing which eliminates streaking and produces yarn spools which are more easily handled by the workmen, and which produce fabrics of greater density, flexibility, and greater stretch and rebound qualities.

4 Claims, 6 Drawing Figures

METHOD OF HANDLING YARN

BACKGROUND AND OBJECTIVES OF THE PRESENT INVENTION

Figure 1:
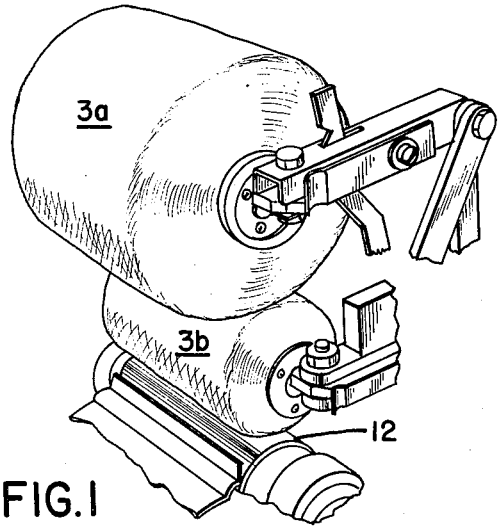

It is common practice in the industry for texturized yarn producers and suppliers to furnish dyeing and finishing operations with texturized yarns which are tightly wound on collapsible stainless steel spring tubular members. The texturized yarns are dyed on these collapsible tubes whereafter the tubes are removed and the yarns are placed on cones for subsequent knitting, weaving or other operations. Oftentimes during dyeing sufficient pressure is not available to force the dye solution through the tightly wound spools of yarn which may weigh two or more pounds and consequently it is later learned, often after a great expenditure of time and labor, that the yarn has not been completely dyed, thus causing streaking in the fabrics in which it is used. Also, the collapsible tubes must be throughly cleaned after each dyeing cycle to remove any dye particles to prevent pollution of dye baths during subsequent use.

With this background in mind one of the objectives of the present invention is to provide a method of treating texturized yarn whereby it will dye in a uniform and even manner.

Another objective of the present invention is to provide a texturized yarn which will be of a bulkier nature than conventional yarns which will thereby provide a denser fabric after knitting, with greater stretch and rebound qualities.

It is also an objective of the present invention to provide a yarn which is greatly less susceptible to breakage after dyeing and therefore causes less waste during subsequent operation including winding, knitting, or other procedures.

Another objective of the present invention is to provide a texturized yarn which is less tensioned during winding and therefore creates a spool of texturized yarn which is wound in its relaxed form allowing for better dye penetration and also resulting in a bulkier yarn after dyeing.

It is still another objective of the present invention to provide a yarn which will be easier to clean prior to dyeing thus having less trimers.

It is still yet another objective of the present invention to provide a spool of yarn which is loosely tensioned and which has rounded corners which allows cool or heated air to pass more freely therethrough and which is not susceptible to unwinding during handling.

Other objectives and advantages of the present invention will become apparent to those skilled in the art as shown in the following pages.

SUMMARY OF THE INVENTION AND DESCRIPTION OF THE DRAWINGS

The invention herein comprises a method and apparatus whereby synthetic texturized yarns are received from a supplier on spools approximately one pound in weight wound on paper tubes or cores. The texturized yarn is then rewound on a perforated metal tube which may be stainless steel or otherwise under far less tension than the original spool. The perforated tube spool is then dyed, dried and then rewound onto a cone for subsequent operations which may include knitting, weaving, or other uses. The texturized yarn thusly treated provides a much bulkier yarn and one that is softer and more uniformly dyed. Conventionally treated yarn cones may demonstrate a durometer hardness of approximately 65–70 whereas cones formed as in this invention have a durometer reading on their outer surface of approximately 40. Also, the yarn of the present invention is much less susceptible to yarn breakage during knitting or rewinding operations due to it being rewound at a much lower tension. Additionally, fabrics produced from the yarns so treated have a much denser appearance due to the greater bulk.

Figure 2:
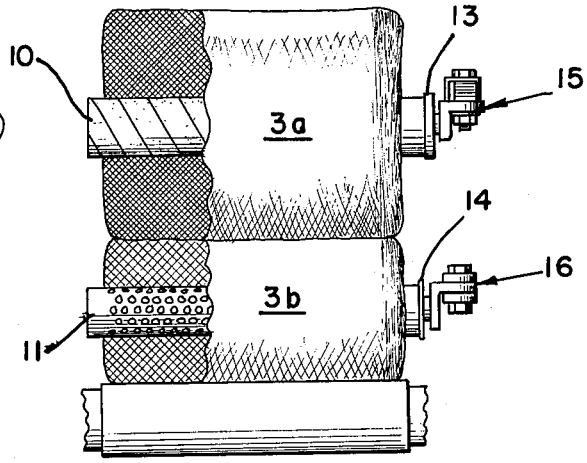
Figure 3:
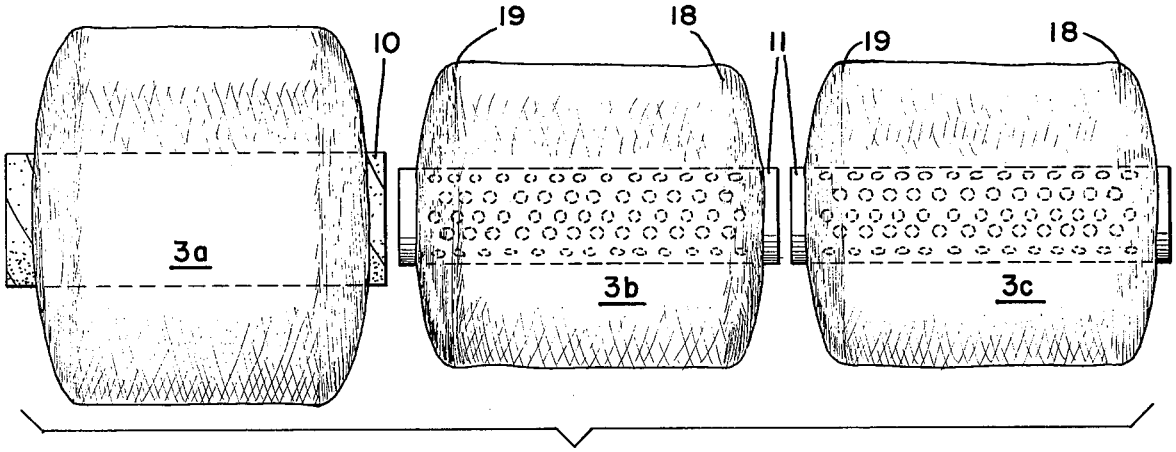
Figure 4:
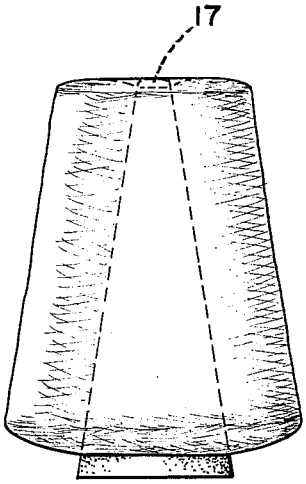
Figure 5:
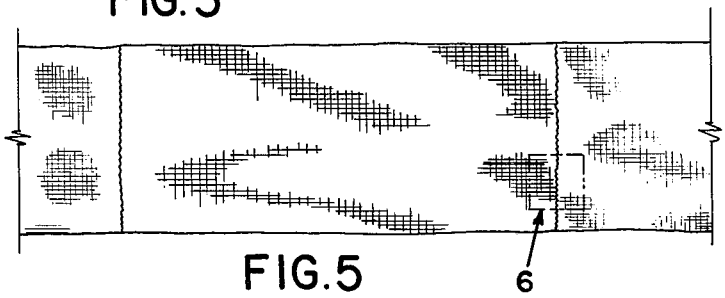
Figure 6:
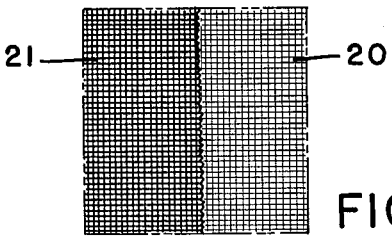

Turning now to the drawings,

FIG. 1 demonstrates the rewinding step of the preferred embodiment present invention;

FIG. 2 illustrates in partial corss-sectional illustration of the winding operation of FIG. 1;

FIG. 3 demonstrates various spools of yarn as utilized in the present invention;

FIG. 4 demonstrates a yarn cone as used herein;

FIG. 5 demonstrates a fabric knit from the yarn as treated in the present invention; and FIG. 6 demonstrates an enlarged view of a section of the fabric shown in FIG. 5.

For a more detailed description of the drawings, yarn package or spool 3*a* demonstrates a conventional texturized synthetic yarn wound on a paper or cardboard tube 10. As further shown in FIG. 3, spools 3*b* and 3*c* are loosely wound on stainless steel perforated metal cores 11 and as shown the size of spools 3*b* and 3*c* approximate the outer dimensions or size of spool 3*a* from which both spools of yarns 3*b* and 3*c* are derived. Spools 3*b* and 3*c* both approximate ½ pound of texturized yarn weight whereas spool 3*a* weighs approximately one pound.

As shown in FIG. 1, yarn package 3*a* is resting on spool 3*b* during the rewinding operation. Spool 3*b* is only partially completed and is being turned by roller means 12 which frictionally engages spool 3*b*. Roller means 12 may be for example a winding roller as featured on a Foster High Speed Winder Model 102.

As shown in FIG. 2, spool spindle means 13 and 14 are adapted to engage respectively tubes 10 and 11 which are positioned horizontally in parallel and spindle means 13 and 14 have connected thereto pivoting assemblies 15 and 16. Assemblies 15 and 16 allow for ease in loading and unloading and for maintenance during operation. No traversing yarn guide means are seen in FIG. 2 as none are required in the preferred embodiment to evenly and uniformly wind the yarn from spool 3*a* to 3*b*. As roller means 12 turns, it causes spool 3*b* to rotate thus winding yarn on itself from spool 3*a*. Spool 3*a* is tightly tensioned and since no tension means are employed in winding spool 3*b*, it becomes a spool of relatively loose tension which accounts for its lighter weight and ease in dyeing and finishing since the dye can be forced therethrough evenly with ease as can warm or cool air during drying.

After dyeing, the spools 3*b* or 3*c* are then rewound onto cones 17 as shown in FIG. 4 for subsequent knitting or other uses. As seen, spools 3*b* or 3*c* have rounded edges 18 and 19 which assist in preventing the yarn spools from being damaged or misaligned during handling. Also, a yarn spool like 3*b* or 3*c* maintains its shape better during the dyeing process since the rounded edges do not become distorted as often time happen with conventional "sharp" yarn spool edges.

As shown in FIG. 6, a section of the fabric of FIG. 5 is enlarged and demonstrates the closer knit or more dense fabric 20 as opposed to less dense fabric 21. The more dense fabric is a result of the bulkier texturized yarn which is achieved through the methods of the present invention believed due in part to the relaxation of the less tensioned yarn during the dyeing and subsequent processes.

The descriptions and drawings of this invention are not intended for purposes of limitation and are only shown as examples for illustration.

What is claimed is:

1. A method for processing texturized yarn comprising: unwinding highly tensioned texturized yarn from a spool, winding the unwound yarn onto a perforated core under a lesser tension by frictionally engaging said perforated core with a roller means, contacting said yarn on said spool with said perforated core, and rotating said roller means to transfer yarn to said perforated core, and treating the yarn wound on said perforated core.

2. A method for processing yarn as claimed in claim 1, wherein said winding texturized yarn onto a perforated core comprises positioning the perforated core horizontally on a rotating member, placing said spool containing texturized yarn on a pivotable rotatable member positioned parallel to said perforated core and in frictional engagement therewith, contacting said perforated core with said roller means, and driving said roller means whereby the yarn is transferred to said perforated core from said spool.

3. A method for processing texturized yarn as claimed in claim 1 wherein the step of winding the yarn onto a perforated core includes the step of winding the yarn onto the perforated core to approximately the same outer dimensions as the spool but with approximately half the yarn weight of the spool.

4. A method for processing texturized yarn as claimed in claim 1 and including the step of rewinding said treated yarn for subsequent yarn operations.

* * * * *